US005504567A

United States Patent [19]

Satoh et al.

[11] Patent Number: 5,504,567

[45] Date of Patent: Apr. 2, 1996

[54] CONTROLLER FOR ROLLER FIXING UNIT FOR COLOR ELECTROPHOTOGRAPHIC APPARATUS

[75] Inventors: Toshiya Satoh, Hitachi; Akiko Oikawa, Nakaminato; Katsuyoshi Onose; Keiziro Yagi, both of Hitachi; Tomoji Kitagishi, Ibaraki, all of Japan

[73] Assignee: Hitachi, Ltd., Tokyo, Japan

[21] Appl. No.: 253,493

[22] Filed: Jun. 3, 1994

[30] Foreign Application Priority Data

Jun. 4, 1993 [JP] Japan ..... 5-134209

[51] Int. Cl.[6] ..... G03G 15/20

[52] U.S. Cl. ..... 355/285; 219/216; 355/208

[58] Field of Search ..... 355/282, 285, 355/290, 208; 219/216, 469, 471; 432/60

[56] References Cited

U.S. PATENT DOCUMENTS

| | | | |
|---|---|---|---|
| 4,046,990 | 9/1977 | White | 219/471 |
| 4,425,494 | 1/1984 | Enomoto et al. | 219/216 |
| 4,671,643 | 6/1987 | Shigemura et al. | 219/216 X |
| 4,920,250 | 4/1990 | Urban | 219/216 |
| 5,041,718 | 8/1991 | d'Hondt et al. | 219/216 X |
| 5,051,780 | 9/1991 | Stelter et al. | 355/208 |
| 5,241,349 | 8/1993 | Nagasaka | 355/285 |
| 5,315,350 | 5/1994 | Hirobe et al. | 355/208 |
| 5,331,384 | 7/1994 | Otsuka | 355/290 |

FOREIGN PATENT DOCUMENTS 54-29650 5/1979 Japan .

*Primary Examiner*—William J. Royer

*Attorney, Agent, or Firm*—Antonelli, Terry, Stout & Kraus

[57] ABSTRACT

A roller fixing unit for a color electrophotographic apparatus having a fixing roller and a pressing roller rotating in contact with each other, at least one of the rollers acting as a heating roller, as well as a control unit for connecting a power source to the heating device for only a predicted time duration based on a detected surface temperature of the heating roller so that the surface temperature of the heating roller reaches a setting temperature before the time when the top end of a first sheet of print medium having a color image arrives at the fixing roller in a case where the surface temperature of the heating roller in a standby state is lower than the setting temperature. The control unit is set to perform a power source connection for every sheet of print media coming out from an intermediate transfer unit in the color electrophotographic apparatus.

8 Claims, 6 Drawing Sheets

CONTROLLER FOR ROLLER FIXING UNIT FOR COLOR ELECTROPHOTOGRAPHIC APPARATUS

BACKGROUND OF THE INVENTION

The present invention relates to a roller fixing unit for a color electrophotographic apparatus.

In a treatment process used in electrophotographic printing, there are a lot of methods of fixing a toner image which has been transferred onto a print medium, such as paper or plastic film. Among the methods, a method utilizing thermal energy has long been known.

In the method utilizing thermal energy, a toner image formed on a print medium is melted by heating so as to adhere to the medium, and for this purpose the toner image is generally pressed by a roller heated up to the temperature at which the material composing the toner becomes adhesive. Especially, when the print medium is paper, the toner is tightly fixed to the printing paper since the toner is melted and part of the toner is absorbed into the fiber of the paper.

A roller fixing unit employing a heated roller is typical among those fixing units utilizing thermal energy, and this type of unit includes a fixing roller and a pressing roller contacting the fixing roller, the print medium having a toner image on it being passed between the rollers to fix the toner. In the roller fixing unit, generally, a heater provided inside a roller is switched on/off by detecting the surface temperature of the roller using temperature detecting element provided near the surface of the roller.

In recent years, however, color toners used in a color electrophotographic apparatus have low softening temperatures compared to the black toner commonly used in a conventional electrophotographic apparatus. Therefore, the roller fixing unit for a color electrophotographic apparatus employs a roller composed of a cylindrical metallic core 5 of aluminum coated with silicon rubber 4 as a fixing roller 1, as shown in the schematic view in FIG. 1, since silicon rubber has excellent removability of toner.

However, since silicon rubber has a low thermal conductivity, the surface temperature of the fixing roller, therefore, largely varies with the passing-through of the print medium, as shown in FIG. 3, and so it has been difficult to maintain the surface at an optimum temperature for fixing the toner by a common control method using a temperature sensor. For this reason, there has been a problem in that image characteristics, such as coloring, density and luster largely vary, and so an image having uniform qualities is difficult to obtain. Especially in a full color printing in which yellow, magenta, cyan and black toners are superposed and melted so as to be fixed in order to reproduce colors at will, it is always required to make the melting degree of each color toner constant. Since the image characteristics are strongly dominated by the fixing temperature of the roller, the roller temperature control is extremely important.

Further, in the conventional roller fixing unit in which the heater is controlled by detecting the surface temperature of the fixing roller, heat on the roller surface in a standby state is removed by passing of the first print medium, resulting in a phenomenon that the surface temperature rapidly drops for a while (hereinafter referred to as "undershoot").

The phenomenon is caused by temperature drop only in a thin surface layer of the silicon rubber coating on the surface of the fixing roller due to the low thermal conductivity of silicon rubber, that is, the phenomenon results from apparent lack of heat in the fixing roller. However, in actual practice the heat stored in the entire roller is not so much decreased. Since a heater controlled on the basis of a roller surface temperature which is apparently lowered is supplied with current to supply the roller with heat energy, the heat in the entire roller is overly supplied. In addition to this, since the heat is conducted to the roller surface with a time lag due to the silicon rubber, there appears a phenomenon that the surface temperature increases higher than a desired set or target temperature (hereinafter referred to as "overshoot").

The undershoot described above causes degradation in image quality due to occurrence of a fixing fault. The overshoot causes offset in the print medium. Especially, since color toners have low softening temperatures, as described above, an offset in the print medium is apt to appear.

In order to solve the problems in the roller fixing unit, various countermeasures have been tried. As a typical fixing unit, the following unit is proposed (Japanese Patent Application Laid-Open No.54-29650 (1979)).

The roller fixing unit referred to above has a fixing roller and a pressing roller having elastic coatings on their surfaces, rotating in contact with each other, at least one of the rollers containing a heater and a temperature sensor in the core portion of the roller, the temperature of the core member being controlled so as to be kept approximately constant throughout a standby period and paper passing period, the temporary temperature drop in the roller surface due to paper passing being compensated with second heating means provided separately from the roller.

The second heating means described above is what heats the roller surface using an external heater, or heats it by causing a heating roller to contact the fixing roller.

The prior fixing unit needs the second heating means as described above, and the setting temperature needs to be always set a little higher than a target temperature. Further, it is important always to keep the unit in an operating state. Therefore, problems arise with regard to the complexity and large scale of the unit, as well from an increase in power consumption.

Summary of the Invention

The object of the present invention is to provide a roller fixing unit for color electrophotography which is capable of suppressing any undershoot and any overshoot in the control of the temperature of the fixing roller due to passing of print media, so as to produce an excellent anti-offset and uniform image characteristics in a unit which is compact in size.

The object of the present invention can be attained by providing the following unit.

A roller fixing unit for a color electrophotographic apparatus having a fixing roller and a pressing roller rotating in contact with each other, at least one of the rollers having heating means, which roller fixing unit is characterized by:

first control means for connecting a power source to the heating means for only a predicted time duration which is set so that the surface temperature of the roller reaches a set temperature before the time when the top end of a first sheet of print medium having a color image arrives at the fixing roller in a case where the surface temperature of the roller in standby state is lower than the set temperature; and second control means for connecting the power source to the heating means before the time when the top end of every sheet of print medium following the first sheet arrives at the fixing roller to compensate the temperature drop of the roller surface due to fixing of the preceding print medium.

The roller fixing unit for a color electrophotographic apparatus, which is characterized by:

control means for connecting a power source to the heating means for only a predicted time duration which is set based on a detected result obtained from surface temperature detecting means so that the surface temperature of the roller reaches a set temperature before the time when the top end of a first sheet of print medium having a color image arrives at the fixing roller in a case where the surface temperature of the roller in standby state is lower than the set temperature, the control means being set to perform a power source connection for every sheet of print media coming out from an intermediate transfer unit in the color electrophotographic apparatus.

A roller fixing unit according to the present invention has a construction as shown in the schematic view of FIG. 1, which is an enlarged view of the roller portion in a fixing unit 31 contained in a color electrophotographic apparatus as shown in FIG. 2. The control method of the roller fixing unit according to the present invention will be described below, referring to FIG. 4.

FIG. 4 is a chart showing optimum set timings for the switching on/off of the current to a heater provided inside the fixing roller and the temperature change on the fixing roller surface at those times. The abscissa indicates a time axis. Therein the origin of time (zero: 0) is when a first sheet of print medium arrives at the fixing roller.

Further, as a example, the figure also shows the behavior at the times of switching on/off of the current to the heater when an arbitrary print medium (for example, an eleventh sheet of print carrier) arrives at the fixing roller. Therein the origin of time (zero: 0') is when the sheet of print medium arrives at the fixing roller.

In FIG. 4, during the standby state, supplying a current supplied to the heater is controlled on the basis of a temperature sensor and controlling means such that the temperature of the roller surface reaches a given set temperature, for example, 145° C.±3° C.

In a case where the surface temperature of the fixing roller in the standby state is lower than the given set temperature (for example, 145° C.), current is started to be supplied to the heater 24 seconds before (first setting time $t_1$: −24) and is stopped at 9 seconds before (second setting time $t_2$: −9) the time (origin 0) when the top end of a first sheet of print medium arrives at the fixing roller. In this case, the current supplying period Δt to the heater is 24−9=15 seconds. By doing this, the surface temperature of the roller becomes approximately 152° C. at the time origin 0. The set temperature for the roller surface at the time origin 0 is set depending on the heat capacity of the print medium and the melting characteristic of toner.

In a case where the surface temperature of the fixing roller in the standby state is equal to the given setting temperature (for example, 145° C.), current is started to be supplied to the heater at 6.5 seconds before (third setting time $t_3$: −6.5) and is stopped at 5.25 seconds before (fourth setting time $t_4$: −5.25) the time (origin 0) when the top end of a first sheet of print medium arrives at the fixing roller. In this case, the current supplying period Δt to the heater is 6.5−5.25=1.25 seconds. By doing this, the surface temperature of the roller becomes approximately 150° C.

Similarly, in a case where each print medium is successively transported to the fixing unit, current is started to be supplied to the heater at 6.5 seconds before ($t_3$) and is stopped at 5.25 seconds before ($t_4$) the time (for example, origin 0' for an eleventh sheet) when the top end of each sheet of print medium arrives at the fixing roller.

Incidentally, the setting times indicated above $t_1$~$t_4$ are simply examples in order to explain the present invention, and may be arbitrarily selected depending on the fixing condition of the print medium.

As can be understood from comparing the chart for the controlled temperature of the fixing roller according to the present invention shown in FIG. 4 with the chart for the controlled temperature of a conventional fixing roller, the present invention can cause the temperature fluctuation (ΔT) in the roller surface to be small and, concurrently, the undershoot and the overshoot can be suppressed. Therewith, it is possible to obtain a uniform color image by preventing occurrence of a fixing fault or offset in the print medium.

It is preferable that the surface of the fixing roller according to the present invention is formed of an elastic member composed of a silicon rubber group of RTV (room Temperature Vulcanization) or LTV (Low Temperature Vulcanization). It is preferable that the rubber elastic member has a hardness of 20~50 degree and thickness of 0.3~5 mm, especially, 20~40 degree and 1~3 mm.

On the other hand, it is preferable that the pressing roller is coated with fluorine rubber, silicon rubber or poly-tetra-fluoro-ethylene, having a hardness larger than 40 degree.

Both the fixing roller and the pressing roller can employ a multi-layer structure formed of silicon rubber and fluorine rubber or poly-tetra-fluoro-ethylene.

Although the description of the present invention has been made in a case where the color electrophotographic apparatus has an intermediate transfer unit (drum) 28 as shown in FIG. 2, in a color electrophotographic apparatus without such an intermediate transfer unit, the time (origin 0 or origin 0') when the top end of the print medium arrives at the fixing roller may be set based on image data, an internal clock in the electrophotographic apparatus or a driving signal in a paper feeder for the print medium.

The present invention relates to a predicting control method where the heat removed from a roller by each sheet of print media passing between the rollers in a fixing unit is predicted before the time when the print medium arrives at the fixing unit and the roller is heated rapidly to raise the roller temperature by operating heating means, such as heater. Thereby, since the time lag in heat transfer due to the elastic member provided on the surface of the roller is eliminated, the undershoot and the overshoot at the starting of fixing can be suppressed. For the same reason, any offset and fixing fault can be prevented, and a fixed image having a uniform quality can be obtained.

DETAILED DESCRIPTION OF THE PREFERRED EMBODIMENTS

The present invention will be described in detail below in connection with preferred embodiments, referring to the accompanied figures. In the figures, the numeral 1 indicates a fixing roller, 2 indicating a pressing roller, 3 indicating a print medium, 4 and 6 indicating silicon rubber layers (elastic member), 5 and 7 indicating aluminum drums, 8 and 9 indicating heating means (heaters), and 10 indicating temperature detecting means, which form part of a fixing unit 31, included in an apparatus. Further, as seen in FIG. 2, 20 indicates a photosensitive belt, 21 indicates a developing unit (yellow), 22 indicates a developing unit (magenta), 23 indicates a developing unit (cyanine), 24 indicates a developing unit (black), 25 indicates a laser beam, 26 indicates a charger, 27 indicates a cleaner, 28 indicates an intermediate transfer drum, 29 indicates a transfer unit, 30 indicates a print medium, 31 indicates a fixing unit, and 32 indicates a cleaner (for intermediate transfer drum).

Figure 1:
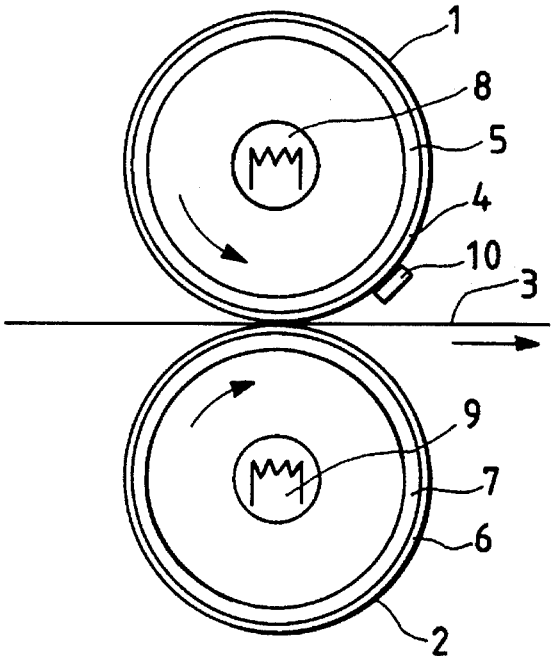
FIG. 1 is a schematic diagram of a roller construction in a fixing unit.

FIG. 1 is a schematic cross-sectional view of a fixing unit employed in an embodiment according to the present invention. A fixing roller 1 is formed of an aluminum drum 5 coated with a layer of silicon rubber 4 thereon. The thickness of the layer is 1.5 mm, the hardness of the layer is 40 degree, and the outer diameter of the roller is 30.0 mmϕ. Heating means (heater) 8 is provided at the central portion of the aluminum drum.

A pressing roller 2 is also formed of an aluminum drum 7 coated with a layer of silicon rubber 6 thereon. Similar to the fixing roller 1, the thickness of the layer is 1.5 mm, the hardness of the layer is 40 degree, and the outer diameter of the roller is 30.0 mmϕ. Heating means 9 is provided in the drum 7 in the same manner as the fixing roller 1. Non-contact type temperature detecting means (thermistor) 10 is provided on the surface in the paper extracting side of the fixing roller 1, and the detected temperature on the fixing roller surface is transmitted to a central processing unit (CPU: not shown in the figure). It is also possible to provide the pressing roller 2 in FIG. 1 with contact type temperature detecting means.

Figure 2:
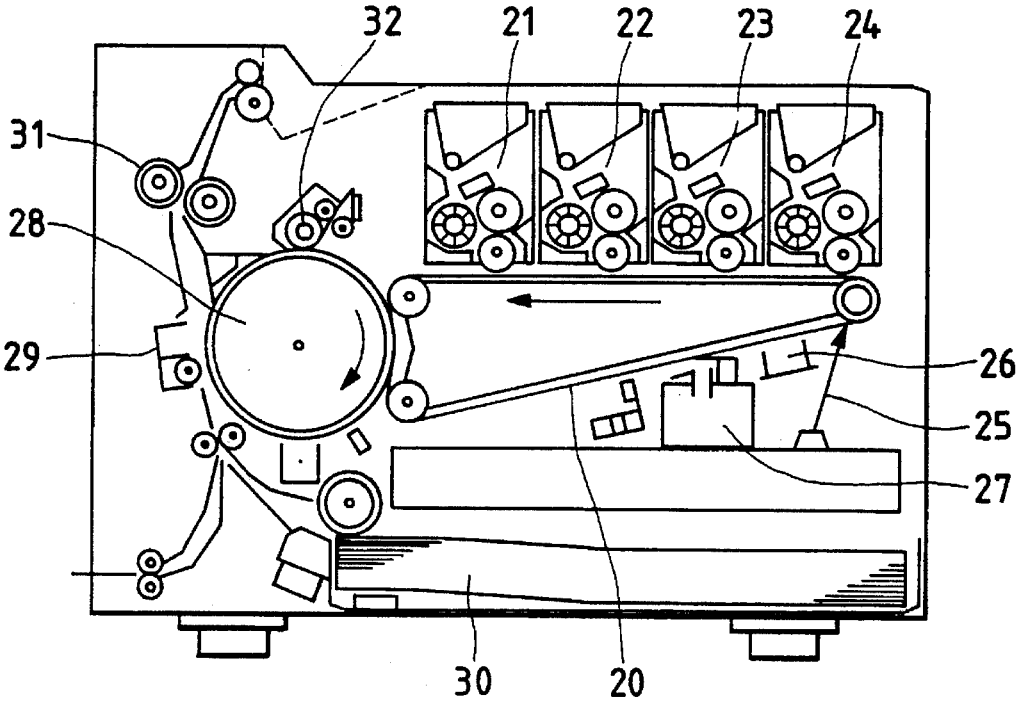
FIG. 2 is a schematic diagram of an electrophotographic apparatus in accordance with the present invention.

FIG. 2 is a schematic view of an electrophotographic apparatus. A photosensitive belt 20 having an organic photoconductive material layer formed on its surface is rotatably driven in the arrow direction. The photoconductive material layer of the photosensitive belt 20 having a certain charge applied by a charger 26 is irradiated by laser 25 controlled in accordance with image information, for example, information corresponding to a yellow component of an image. The charge on the portion of the organic photoconductive material layer irradiated by the laser is eliminated to form an electrostatic latent image on the surface of the photoconductive material layer.

Next, the electrostatic latent image formed on the photoconductive material layer on the photosensitive belt 20 is developed by the frictionally charged toner in a developing agent contained in a developing unit (yellow) 21 so as to be converted to a visual image, the visual image being transferred to an intermediate transfer drum 28 so as to form a toner image.

The above processes are performed in the order of yellow, magenta, cyanine and black to form a full-color visual image on the intermediate transfer drum 28 by superposing the above four colors. After the full-color visual image is formed, the full-color visual image is transferred onto a print medium 30 using a transfer unit 29 and is then transported to a fixing unit 31 so as to be thermally fixed.

In the above electrophotographic apparatus, it takes 30~45 seconds from starting of operation when a printing mechanism receives image data to the time when a first print medium arrives at the fixing unit. The range in the required time results from the fact that the number of processes forming color toner images on the intermediate transfer drum 28 differs depending on the number of color superpositions to be required for reproducing the transferred image.

The time from the starting of operation of the printing mechanism to the time when a first print medium arrives at the fixing unit is judged based on the image data. The set timings for switching on/off of current to the heating means (heater) provided in the roller of the fixing unit, providing the origin is the time when a print medium arrives at the fixing roller (origin 0 or origin 0' in FIG. 4), are determined by a calculation performed by the CPU based on the internal clock of the electrophotographic apparatus and the temperature of the roller surface at the time. The heat capacity of a print medium to be fixed is determined with a preset value using the printing size obtained from the image data and the thickness of the print medium. The preset values are stored in the memory of the CPU. The data concerning the heat capacity is fetched at the time of calculation by the CPU to determine the time $\Delta t$ or $\Delta t'$ for supplying current to the heating means. Based on the result, the timings $t_1$~$t_4$ for switching on/off of the current to the heating means are set.

Since the heat capacities of print media, paper and OHP sheet differ, it is important to set the timings $t_1$~$t_4$ according to the kind of print media.

It may also be possible to control the set timings based on the rotation starting signal for the intermediate transfer drum 28 or the paper feeding roller in the electrophotographic apparatus.

The toners used in the embodiment in accordance with the present invention and an example for comparison are prepared by adding the following color agents and charge control agents to a 100 weight part of the bis-phenol polyester resin (mass average molecular weight $M_w$=12,000, $M_w$/Mn=8.9, glass transition temperature Tg=56° C., softening temperature Tm=100° C.), where Mn is number average molecular weight.

| | | |
|---|---|---|
| (1) | magenta | |
| | C.I. pigment red 206 | 4.0 weight part |
| | C.I. solvent red 109 | 1.5 weight part |
| | organic acid salt containing chromium | 4.0 weight part |
| (2) | cyanine | |
| | phthalocyanine | 5.0 weight part |
| | organic acid salt containing chromium | 4.0 weight part |
| (3) | yellow | |
| | pigment yellow 6 | 5.0 weight part |
| | organic acid salt containing chromium | 4.0 weight part |
| (4) | black | |
| | carbon black | 5.0 weight part |
| | organic acid salt containing chromium | 4.0 weight part |

Each of the mixtures is mixed and heated using a roller mil, being coarsely ground using a cutting mil after being cooled, and is further ground using an ultrasonic jet mil, which is classified using a zigzag classifier to get toner having an average particle diameter of 11 μm. Then, the mixture is mixed with a Ferrite Carrier F-150 (a product of Powder Tech Co.) with a ratio of 3:97 to obtain a two-component developing agent.

A fixing unit having the roller structure shown in the schematic view of FIG. 1 is mounted on a color electrophotographic apparatus of the type shown in FIG. 2. Evaluations on fixing ability and image quality of an image formed are performed using the two-component developing agents, 50 sheets each of two kinds of print media, A4 sized standard print paper (thickness of 100 μm) and A4 sized standard OHP sheets (thickness of 100 μm).

The fixing ability of an image: The fixing ability of an image is evaluated with the occurrence of an off-set (x) and the lack of occurrence of an off-set (o).

The quality of image: In a case of using paper as the print medium, the density of the image is measured using a reflection type densimeter RD-918 (a product of Macbeth Co.) and the widths of variation in density ΔOD are compared. On the other hand, in a case of using OHP sheet as the print medium, the transmittance of light is measured using a spectrophotometer 330 type (a product of Hitach, Ltd.) and the ratios of variation (%) in the transmittance are compared. It is preferable for ΔOD to be less than 0.3, since unevenness in the image can be recognized visually when ΔOD is larger than 0.3.

[Embodiment 1]

The surface temperature of the fixing roller is measured under the condition that print paper is used as the print medium, the initial current supplying duration (Δt) for the heater to obtain the widths of fluctuation ΔT (°C.) between maximum temperature ($T_H$) and minimum temperature ($T_L$) being varied. The difference ΔOD between the maximum and minimum in image density is also measured. The result is shown in Table 1. Therein, the passing speed of the print medium through the fixing roller portion is 70 mm/s.

TABLE 1

| | First set timing $t_1$ (seconds) | | | | | |
|---|---|---|---|---|---|---|
| | −10 | −15 | −20 | −24 | −25 | −30 |
| Initial heater current supply duration Δt (sec) | | | | | | |
| 0 | 47 | 47 | 47 | 47 | 47 | 47 |
| | x | x | x | x | x | x |
| 10 | 45 | 42 | 38 | 35 | 37 | 44 |
| | 0.95 | 0.80 | 0.66 | 0.60 | 0.65 | 0.90 |
| 12 | — | 37 | 32 | 30 | 33 | 40 |
| | | 0.70 | 0.50 | 0.42 | 0.50 | 0.95 |
| 15 | — | 32 | 30 | 27 | 30 | 35 |
| | | 0.60 | 0.40 | 0.35 | 0.50 | 1.00 |
| 17 | — | — | 32 | 32 | 33 | 40 |
| | | | 0.45 | 0.40 | 0.47 | 0.80 |
| 20 | — | — | — | — | — | — |
| | | | x | x | x | x |

upper column: ΔT (°C.) lower column: ΔOD

Figure 3:
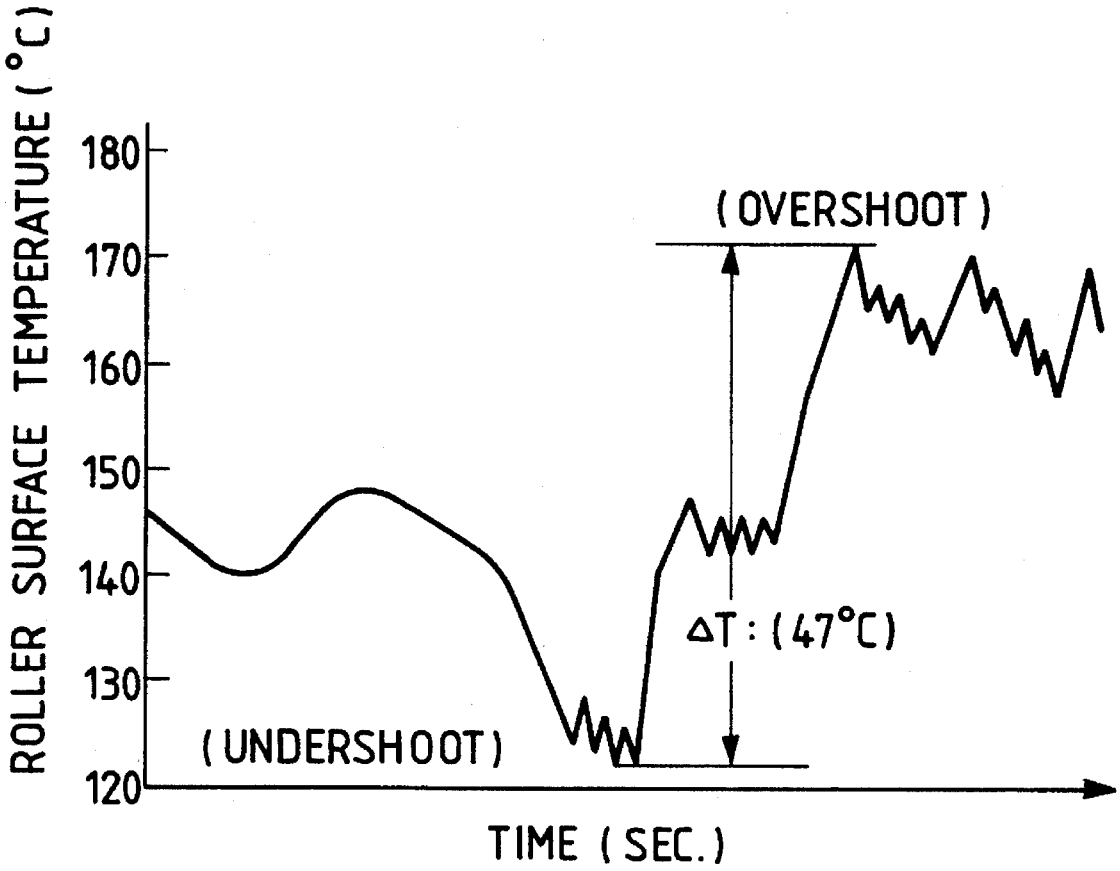
FIG. 3 is a characteristic diagram showing the temperature change of a fixing roller in a conventional fixing unit.

As shown in Table 1, when the initial heater current supply duration Δt is 0 (zero) second, that is, the temperature control method is the same as the conventional control method, the width of temperature fluctuation ΔT on the fixing roller surface becomes large and the offset appears as shown in FIG. 3. It can be understood from Table 1 that when Δt is 20 seconds, the temperature of the fixing roller surface gradually increases as the number of sheets of the print media increases, and arrives up to the offset occurrence temperature (approximately 170° C.) to cause an offset.

With taking note of the first set timing $t_1$, that is, the initial heater current starting time, when $t_1$ is 24 seconds before zero time, the width of the temperature fluctuation ΔT on the fixing roller surface becomes a minimum and the image density difference ΔOD also becomes a minimum regardless of the magnitude of the initial heater current supply duration Δt.

Further, when $t_1$ is 24 seconds before zero time and the initial heater current supply duration Δt is 15 seconds before zero time ($t_2$ is 9 second before zero time), the width of the temperature fluctuation ΔT on the fixing roller surface becomes a minimum and the image density difference ΔOD also becomes a minimum regardless of the magnitude of the initial heater current supply duration Δt.

[Embodiment 2]

The width of temperature fluctuation ΔT on the fixing roller surface is measured under the condition that print paper is used as the print medium, $t_1$ being fixed in 24 seconds, $t_2$ being fixed in 9 seconds, the third set timing $t_3$ (the time to start supplying current to the heater before each sheet of the print paper arrives at the fixing roller) and the heater current supplying duration Δt' ($t_3$–$t_4$) being varied. The difference ΔOD between the maximum and minimum in image density is also measured. The result is shown in Table 2.

TABLE 2

| | Third set timing $t_3$ (seconds) | | | | |
|---|---|---|---|---|---|
| | −4.5 | −5.5 | −6.5 | −7.5 | −8.5 |
| Heater current supplying duration Δt' (seconds) | | | | | |
| 0 | 27 | 27 | 27 | 27 | 27 |
| | 0.35 | 0.35 | 0.35 | 0.35 | 0.35 |
| 0.5 | 26 | 25 | 23 | 24 | 25 |
| | 0.35 | 0.33 | 0.32 | 0.33 | 0.35 |
| 1.0 | 25 | 23 | 21 | 21 | 23 |
| | 0.35 | 0.30 | 0.30 | 0.30 | 0.35 |
| 1.25 | 25 | 20 | 14 | 17 | 20 |
| | 0.35 | 0.30 | 0.20 | 0.25 | 0.30 |
| 1.4 | 26 | 21 | 17 | 20 | 23 |
| | 0.34 | 0.30 | 0.25 | 0.30 | 0.33 |
| 1.5 | — | — | — | — | — |
| | x | x | x | x | x |

upper column: ΔT (°C.) lower column: ΔOD

It can be understood from Table 2 that when Δt' is 1.5 seconds, the temperature in the fixing roller surface gradually increases as the number of sheets of the print paper increases, and arrives at the offset occurrence temperature (approximately 170° C.) to cause an offset.

In Table 2, the region of ΔOD less than 0.3 is the third set timing $t_3$ of 2 to 4 seconds before zero time and the heater current supplying duration Δt' of 1.0 to 1.4 seconds, which is the optimum range.

Figure 4:
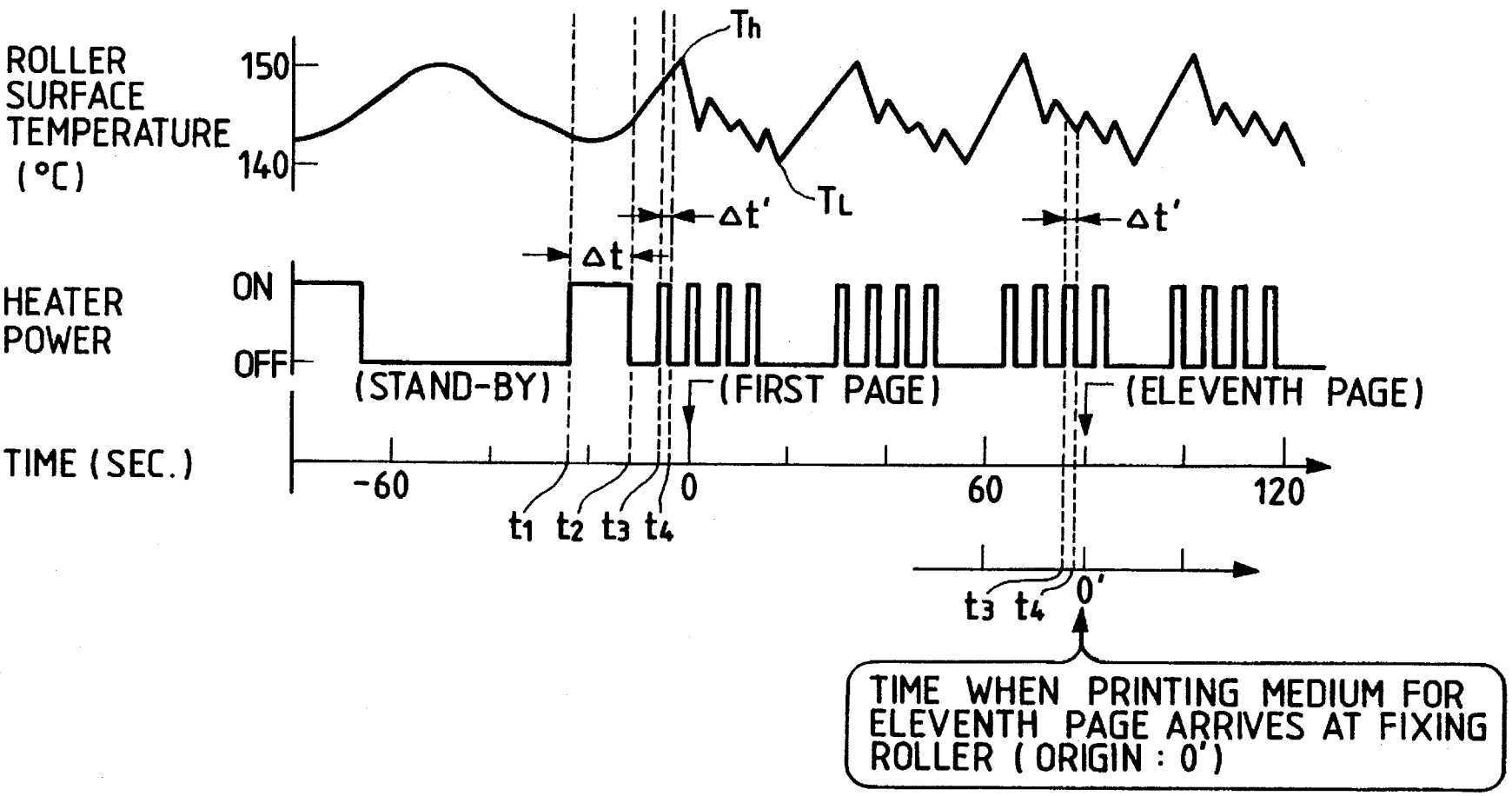
FIG. 4 is a diagram showing the set timings for switching on/off of the current to a heater in a fixing unit in accordance with the present invention and the temperature change on the roller surface.

FIG. 4 is a chart showing the optimum set timings for switching on/off of the current to a heater in the embodiments 1 and 2 and the temperature change on the roller surface.

In FIG. 4, the heater current supply starts at 24 seconds ($t_1$) zero time before and ends at 9 seconds ($t_2$) before a first sheet of print paper is transported to the fixing unit only in the case where the surface temperature of the fixing roller is below the given temperature (145° C.).

In a case where sheets of print paper are continuously transported, the heater current supply starts at 6.5 seconds ($t_3$) before zero time and ends at 5.25 seconds ($t_4$) before the top end of each of the print paper arrives at the fixing roller (current supplying duration Δt' is 1.25 seconds).

The temperature fluctuation on the fixing roller in the present invention can be decreased compared to that in the conventional method in which control is performed by detecting the surface temperature of the fixing roller.

[Embodiment 3]

The width of temperature fluctuation ΔT on the fixing roller surface is measured under the condition that OHP sheet is used as the print medium, $t_1$ being fixed at 24 seconds, $t_2$ being fixed at 9 seconds, before each sheet of the print paper arrives at the fixing roller, the difference $t_3$–$t_4$, that is, the heater current supplying duration Δt', being varied as shown in Table 2. The ratio of variation (%) in the transmittance of an image is also measured. The result is shown in Table 3.

It is preferable that the ratio of variation in the transmittance is less than 20%. Therein, the passing speed of the OHP sheet through the fixing roller portion is 35 mm/s.

TABLE 3

| | Heater current supplying duration Δt' (seconds) | | | | | |
|---|---|---|---|---|---|---|
| | 1.25 | 2.0 | 3.0 | 4.0 | 5.0 | 6.0 |
| Fluctuation in roller temp. ΔT (°C.) | 30 | 27 | 25 | 20 | 17 | — |
| Trend of roller temp. | const | const | const | const | const | up |
| Variation in transmittance | 20 | 18 | 15 | 7 | 5 | — |
| Fixing ability | ○ | ○ | ○ | ○ | ○ | x |

const: constant
up: increase
○: off-set not occurred
x: off-set occurred

It can be understood from Table 3 that when the heater current supplying durations Δt's' are 1.25, 2.0, 3.0 seconds, both the fluctuation in the fixing roller surface temperature ΔT and the variation in the transmittance ratio are large although the fixing ability is good. When the heater current supplying duration Δt' is 6.0 seconds, the temperature in the fixing roller surface gradually increases as the number of sheets of the print media increases, and causes an offset (approximately 165° C.).

In this embodiment, it is revealed that the optimum heater current supplying duration Δt' is 4 to 5 seconds, especially, 5 seconds.

Although sheets of A4 size have been used as the print media in the above embodiments, it is obvious that the print media are not limited as to size.

As described above, in the roller fixing unit for a color electrophotographic apparatus in accordance with the present invention, the heat removed from the fixing roller by a sheet of print media passing through the fixing unit is predicted, and, based on the predicted result, the roller is heated rapidly to raise the roller temperature by operating a heater before the time when the print medium arrives at the fixing unit. Thereby, the fluctuation ratio in the roller surface temperature can be suppressed, and any undershoot at the starting of fixing and overshoot during the fixing operation can be also suppressed, which prevents and offset and fixing fault from occurring.

Further, since the time lag in heat transfer due to the elastic member provided on the surface of the roller is taken into consideration in operating the heater, a fixed image having a uniform quality can be obtained. Especially, in accordance with the present invention, it is unnecessary to make the apparatus more complex since there is no need separately to add heating means for heat compensation.

A controller for executing temperature control as described above will be described below, referring to FIG. 5 to FIG. 7.

Figure 5:
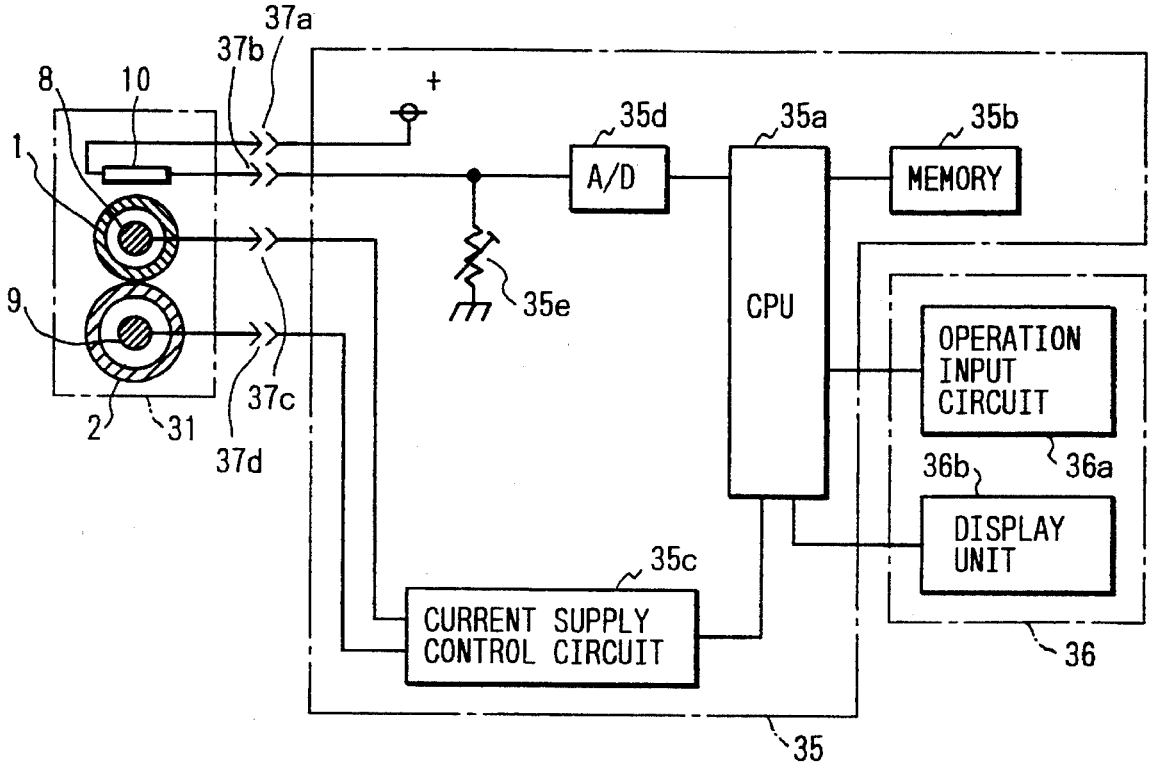
FIG. 5 is a block diagram of a controller in accordance with the present invention.

A controller according to the present invention comprises a main control part 35 and a operating control part 36 as shown in FIG. 5. The main control part 35 comprises a CPU 35*a*, a memory 35*b*, a current supplying control circuit 35*c*, an A/D converter 35*d* and an adjustable resister 35*e*, and is connected to the heaters 8, 9 and the thermistor 10 through connectors 37*a* to 37*d*. The operating control part 36 comprises an operating input circuit 36*a* and a display 36*b*, and is connected to the main control part 35.

According to a program stored in the memory 35*b*, the CPU receives a detected temperature signal from the thermistor 10 and a command signal from the operating input circuit 36*a* to execute current control processing for the heaters 8, 9 and display control processing for the display 36*b*. The current supplying control circuit 35*c* is in charge of switching on/off the supply of current to the heaters 8, 9. The current supplying control processing by the CPU 35*a* is a process for applying a control command signal to the current supplying control circuit 35*c*.

Figure 6:
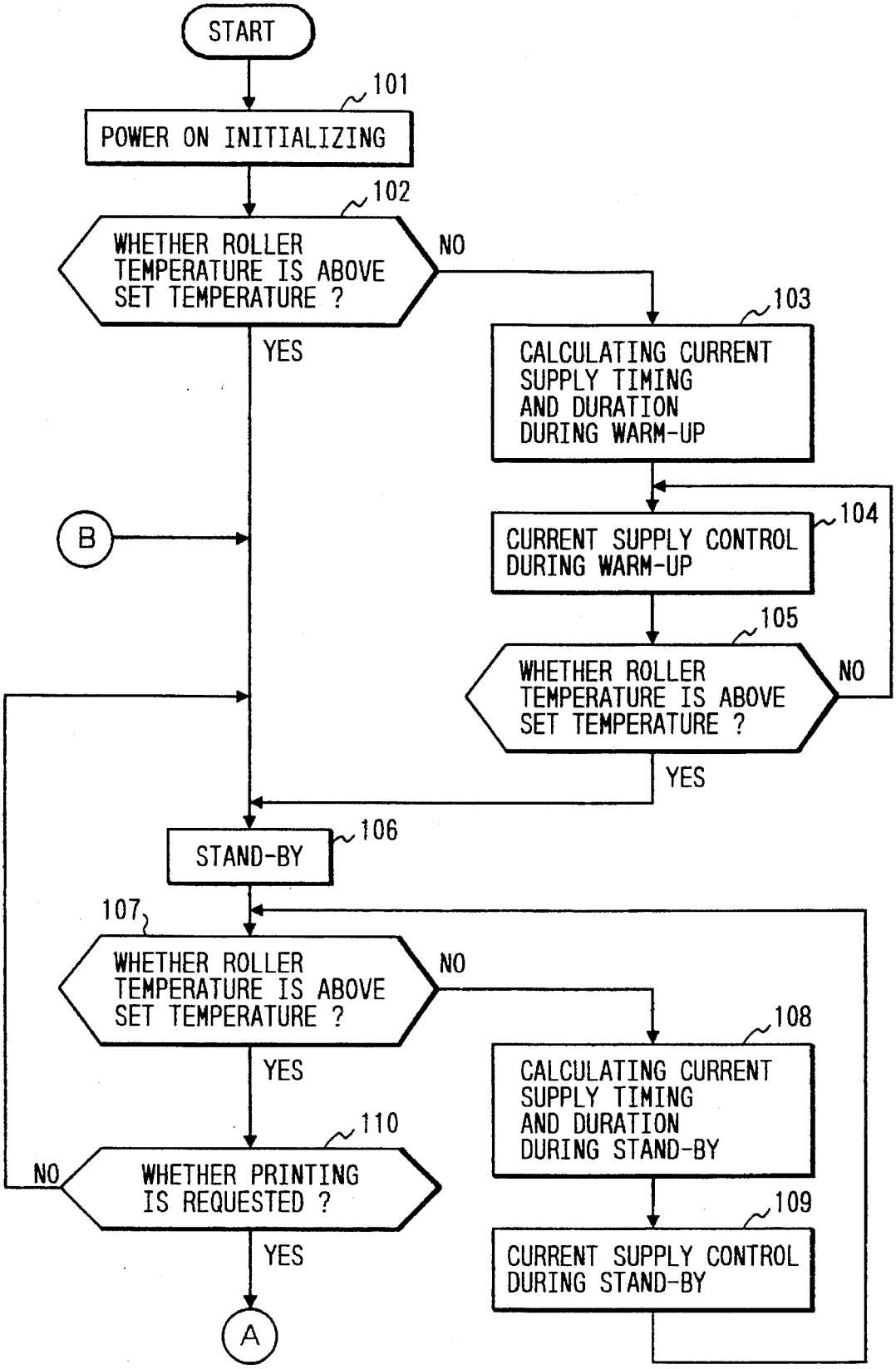
FIG. 6 is a flowchart of a current supplying control process for temperature control executed by a CPU in a controller in accordance with the present invention.
Figure 7:
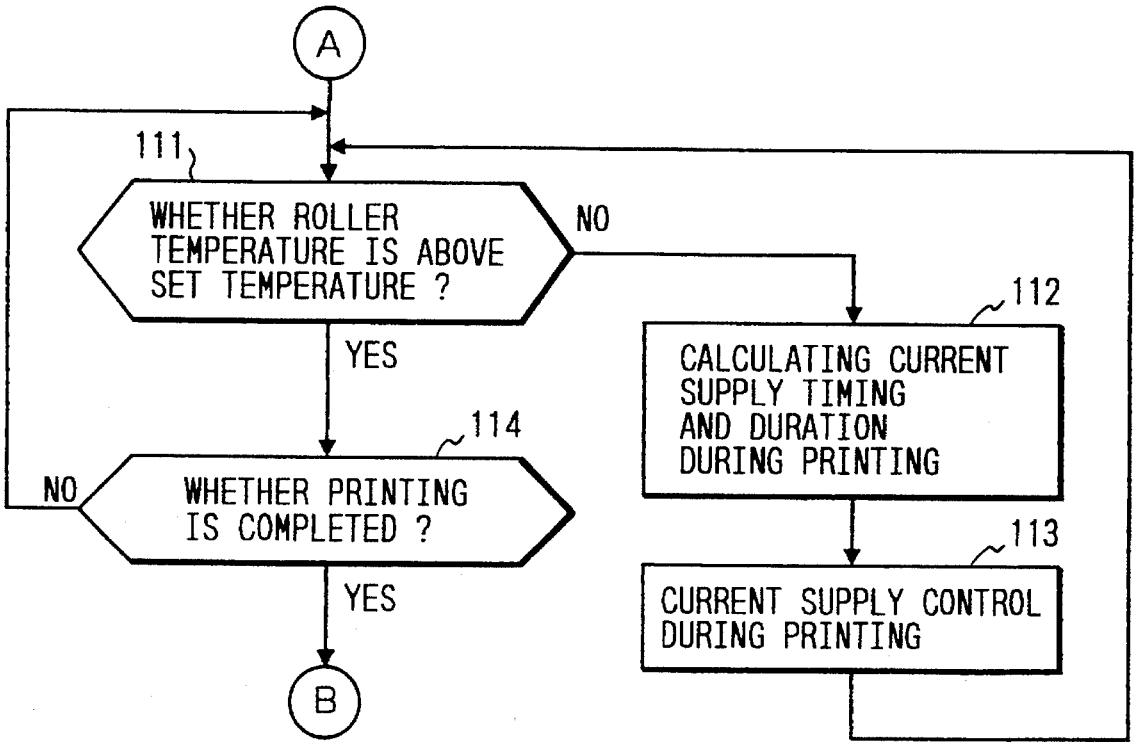
FIG. 7 is a flowchart of a current supplying control process for temperature control executed by a CPU in a controller in accordance with the present invention.

FIG. 6 and FIG. 7 show the current supplying control processing executed by the CPU 35*a*.

Step 101 is an initial process at turning on of the power switch of the electrophotographic apparatus.

In step 102, the detected temperature signal from the thermistor 10 is checked to confirm whether the temperature of the fixing roller 1 in the fixing unit 31 is above a set temperature or not.

If the temperature of the fixing roller 1 in the fixing unit 31 is lowered below the set temperature, the processing proceeds to step 103 and executes a calculating process for calculating a current supply timing and a current supplying duration suitable for the control characteristic at warm-up. In step 104, the control signal according to the current supply timing and the current supplying duration calculated in step 103 is transmitted to the current supplying circuit 35*c* to perform an on/off control of current supply to the heaters 8, 9. By proceeding to step 105, it is confirmed whether the temperature of the fixing roller 1 is above the set temperature or not.

When the temperature of the fixing roller 1 reaches above the set temperature, the processing proceeds to step 106 to enter a stand-by state. In step 107, it is confirmed whether or not the temperature of the fixing roller 1 in the fixing unit 31 during the stand-by state is above the set temperature by checking the detected temperature signal from the thermistor 10.

If the temperature of the fixing roller 1 is lower than the set temperature, the processing proceeds to step 108 to execute a calculating process for calculating the current supply timing and the current supplying duration suitable for the control characteristic at the stand-by state. In step 109, the control signal according to the current supply timing and the current supplying duration calculated in step 108 is transmitted to the current supply control circuit 35*c* to perform on/off control for supplying current to the heaters 8, 9, and then the processing returns to step 107.

If the temperature of the fixing roller 1 is kept above the set temperature, the processing proceeds to step 110 to confirm whether there is a print request signal or not. If there is a print request signal, the processing proceeds to step 111 to confirm whether or not the temperature of the fixing roller 1 in the fixing unit 31 is above the set temperature by checking the detected temperature signal from the thermistor 10.

If the temperature of the fixing roller 1 is lowered below the set temperature, the processing proceeds to step 112 to execute a calculating process for calculating the current supply timing and the current supplying duration suitable for the control characteristics, taking the number of fixing sheets in printing operation into consideration. In step 113, the control signal according to the current supply timing and the current supplying duration calculated in step 112 is transmitted to the current supply control circuit 35*c* to perform on/off control for supplying current to the heaters 8, 9, and then the processing returns to step 111.

In step 114, it is confirmed whether or not the printing is completed. The current supply control process during printing operation is continued until the printing is completed.

We claim:

1. A roller fixing unit for a color electrophotographic apparatus having a fixing roller and a pressing roller rotating in contact with each other, at least one of the rollers having heating means, which roller fixing unit comprises:

first control means for connecting a power source to the heating means for only a time duration predicted and set so that the surface temperature of the one roller reaches a set temperature before a time when the top end of a first sheet of print medium having a color image arrives at the fixing roller in a case where the surface temperature of the one roller in a standby state is lower than the set temperature; and second control means for connecting the power source to the heating means before the time when the top end of every sheet of print medium following the first sheet arrives at the fixing roller to compensate the temperature drop of the one roller surface due to fixing of a preceding print medium.

2. A roller fixing unit for a color electrophotographic apparatus according to claim 1, which comprises:

predicting control means for predicting and setting the time duration to connect the power source to the heating means in the one roller depending on the heat capacity of the print medium.

3. A roller fixing unit for a color electrophotographic apparatus according to claim 1, wherein:

the fixing roller is covered with an elastic rubber-like member on the surface of a cylindrical metallic core, said heating means being disposed inside the cylindrical metallic core.

4. A roller fixing unit for a color electrophotographic apparatus according to claim 3, wherein:

the pressing roller has an electric heater operating as the heating means inside the cylindrical metallic core thereof.

5. A roller fixing unit for a color electrophotographic apparatus according to claim 1, wherein:

both the fixing roller and the pressing roller are covered with elastic rubber-like members on the surfaces of cylindrical metallic cores.

6. A roller fixing unit for a color electrophotographic apparatus according to claim 1, further comprising connection control means which includes means for automatically controlling connection and disconnection of current to said heating means in the fixing roller before the time when the top end of a print medium arrives at the fixing roller based on a command calculated by a central processing unit (CPU) using a surface temperature signal of the fixing roller detected by a noncontacting type temperature detecting means provided on the print medium outgoing side of the fixing roller, an operation starting signal of a printing mechanism in the electrophotographic apparatus and signal representing a heat capacity of the print medium previously set in accordance with the thickness and size of the print medium.

7. A roller fixing unit for a color electrophotographic apparatus having a fixing roller and a pressing roller rotating in contact with each other, at least one of the rollers having heating means, which roller fixing unit comprises:

first control means for connecting a power source to the heating means at a first set time before the time when the top end of a first sheet of print medium having a color image arrives at the fixing roller and disconnecting the power source from the heating means at a second set time predicted and set so that the surface temperature of the one roller reaches a set temperature in a case where the surface temperature of the one roller in a standby state is lower than the set temperature; and second control means for connecting the power source to the heating means at a third set time before the time when the top end of every sheet of print medium following the first sheet arrives at the fixing roller to recover the surface temperature of the one roller to the set temperature.

8. A roller fixing unit for a color electro-photographic apparatus having a fixing roller and a pressing roller rotating in contact with each other, at least one of the rollers having heating means, and a temperature detecting means, which roller fixing unit comprises:

first control means for connecting a power source to the heating means for only a time duration predicted and set on a basis of a detected surface temperature of the one roller produced by the temperature detecting means so that the surface temperature of the one roller reaches a set temperature before a time when the top end of a first sheet of print medium having a color image arrives at the fixing roller in a case where the surface temperature of the one roller in a standby state is lower than the setting temperature, and connection control means operating to perform a power source connection for every sheet of print medium coming out from an intermediate transfer unit in the color electrophotographic apparatus.

* * * * *